US009761961B2

(12) United States Patent
Wendt et al.

(10) Patent No.: US 9,761,961 B2
(45) Date of Patent: Sep. 12, 2017

(54) LEAD-THROUGH TERMINAL

(71) Applicant: PHOENIX CONTACT GMBH & CO. KG, Blomberg (DE)

(72) Inventors: Andreas Wendt, Berlin (DE); Ralf Beckmann, Detmold (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days.

(21) Appl. No.: 15/023,410

(22) PCT Filed: Aug. 12, 2014

(86) PCT No.: PCT/EP2014/067210

§ 371 (c)(1),
(2) Date: Mar. 21, 2016

(87) PCT Pub. No.: WO2015/039813

PCT Pub. Date: Mar. 26, 2015

(65) Prior Publication Data

US 2016/0211592 A1 Jul. 21, 2016

(30) Foreign Application Priority Data

Sep. 23, 2013 (DE) ..... 10 2013 110 479

(51) Int. Cl.
*H01R 4/28* (2006.01)
*H01R 4/50* (2006.01)
*H01R 4/48* (2006.01)

(52) U.S. Cl.
CPC ..... *H01R 4/5008* (2013.01); *H01R 4/4827* (2013.01)

(58) Field of Classification Search
CPC .. H01R 4/4836; H01R 4/4845; H01R 4/4881; H01R 4/489

(Continued)

(56) References Cited

U.S. PATENT DOCUMENTS 4,759,726 A * 7/1988 Naylor ..... H01R 4/5008 439/441
6,004,168 A * 12/1999 Fuchs ..... H01R 4/4845 439/630

(Continued)

FOREIGN PATENT DOCUMENTS

DE 19611762 A1 10/1997
DE 29807956 U1 7/1999

(Continued)

*Primary Examiner* — Abdullah Riyami
*Assistant Examiner* — Thang Nguyen
(74) *Attorney, Agent, or Firm* — Leydig, Voit & Mayer, Ltd.

(57) ABSTRACT

A lead-through terminal includes a terminal housing to be held on a wall of an electrical installation, and a wall feedthrough and a pivotable actuation device being provided on the terminal housing. The actuation device is pivotable at least between a contact position and an open position to clamp a conductor at a conductor receptacle in the contact position and to release or hold the conductor at the conductor receptacle in the open position. A gap that exists between the actuation device and the wall feedthrough when the actuation device pivots between the open position and the contact position is closed at least in the contact position.

16 Claims, 5 Drawing Sheets

(58) Field of Classification Search
USPC ..... 439/725, 441, 835
See application file for complete search history.

(56) References Cited

U.S. PATENT DOCUMENTS

| | | | | |
|---|---|---|---|---|
| 6,464,545 | B2 * | 10/2002 | Yano | H01R 9/26 439/441 |
| 8,444,443 | B2 * | 5/2013 | Schafmeister | H01R 4/4836 439/441 |
| 2005/0090159 | A1 * | 4/2005 | Luther | H01R 4/4836 439/835 |
| 2007/0141910 | A1 * | 6/2007 | Camino | H01R 4/4872 439/607.41 |
| 2010/0081316 | A1 * | 4/2010 | Eppe | H01H 1/5844 439/441 |
| 2011/0223795 | A1 | 9/2011 | Schafmeister | |
| 2013/0090024 | A1 * | 4/2013 | Seberger | H01R 4/48 439/851 |
| 2014/0322957 | A1 | 10/2014 | Wendt | |
| 2015/0047898 | A1 | 2/2015 | Sagdic | |

FOREIGN PATENT DOCUMENTS

| | | | |
|---|---|---|---|
| DE | 19825629 | A1 | 12/1999 |
| DE | 102008039868 | A1 | 3/2010 |
| DE | 102011055845 | A1 | 5/2013 |
| WO | WO 2013135698 | A1 | 9/2013 |

* cited by examiner

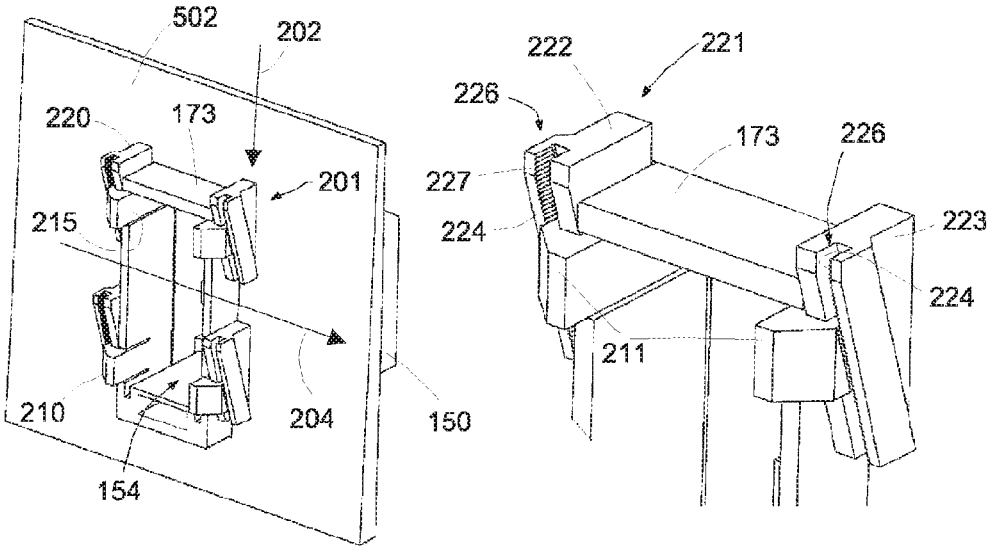
Fig. 4
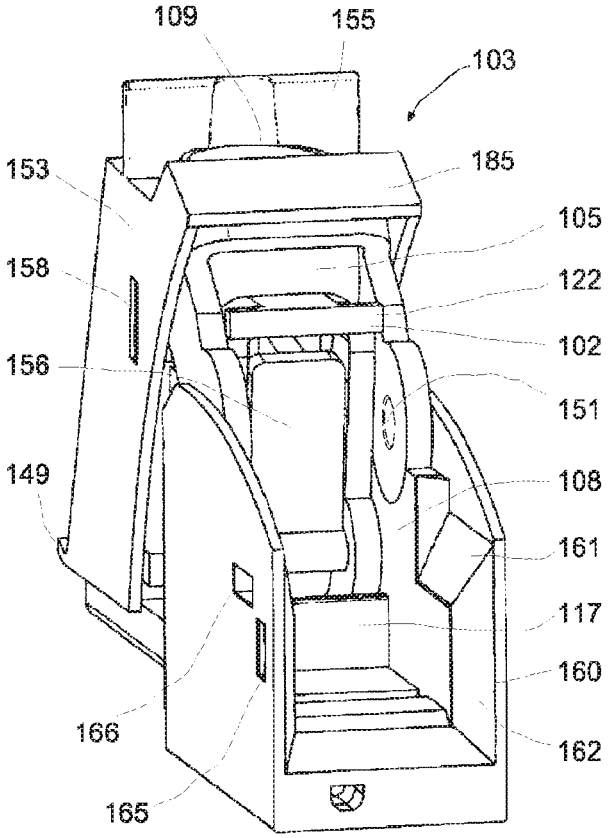
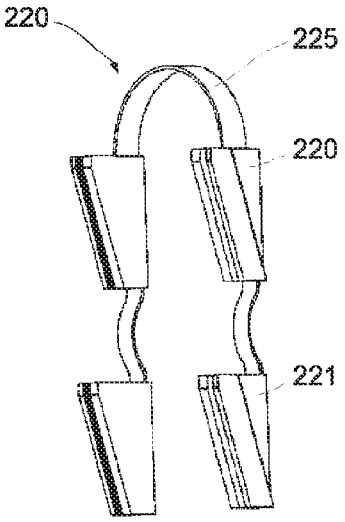
Fig. 5
Fig. 6

LEAD-THROUGH TERMINAL

CROSS-REFERENCE TO PRIOR APPLICATIONS

This application is a U.S. National Phase application under 35 U.S.C. §371 of International Application No. PCT/EP2014/067210, filed on Aug. 12, 2014, and claims benefit to German Patent Application No. DE 10 2013 110 479.7, filed on Sep. 23, 2013. The International Application was published in German on Mar. 26, 2015 as WO 2015/039813 A1 under PCT Article 21(2).

FIELD

The present invention relates to a lead-through terminal that is suitable and intended for being held on a wall of an electrical installation. In the process, an actuation device is provided, which clamps a conductor at a conductor receptacle when in a contact position and releases or holds a conductor at the conductor receptacle when in an open position.

BACKGROUND

The prior art discloses lead-through terminals.

SUMMARY

A lead-through terminal includes a terminal housing to be held on a wall of an electrical installation, and a wall feedthrough and a pivotable actuation device being provided on the terminal housing. The actuation device is pivotable at least between a contact position and an open position to clamp a conductor at a conductor receptacle in the contact position and to release or hold the conductor at the conductor receptacle in the open position. A gap that exists between the actuation device and the wall feedthrough when the actuation device pivots between the open position and the contact position is closed at least in the contact position.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following:

FIG. 4 is a schematic perspective view of a wall of an electrical installation having a terminal housing held thereon, and of an enlarged detail thereof;

FIG. 5 shows a different latching unit for the terminal housing according to FIG. 4;

FIG. 6 is a schematic perspective view of an open lead-through terminal without an outer housing;

DETAILED DESCRIPTION

Figure 1:
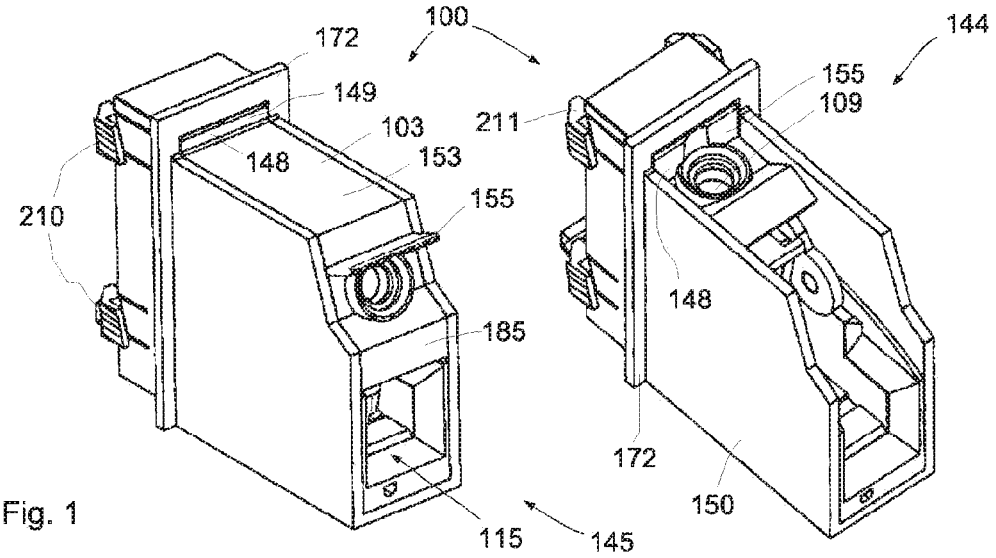
FIG. 1 is a perspective view of a lead-through terminal in the contact position and open position.

A lead-through terminal according to the invention comprises a terminal housing, by which the lead-through terminal can be held on a wall of an electrical installation. A wall feedthrough and a pivotable actuation device are provided on the terminal housing. The actuation device can pivot between a contact position and an open position. The actuation device is formed and designed to clamp a conductor at a conductor receptacle when in the contact position and to release and/or hold a conductor at the conductor receptacle when in the open position. In the process, a gap that exists or is possibly produced when the actuation device pivots between the open position and the contact position is closed or in any case closed again in the contact position. Such a gap may occur between the actuation device and the wall feedthrough.

The lead-through terminal according to the invention is advantageous since it allows for a particularly secure and reliable configuration in the contact position. If the actuation device is arranged such that for example a gap between a part of the actuation device and the terminal housing is produced at the wall feedthrough when the actuation device moves from the open position into the contact position, said gap is reliably closed at least in the contact position, and so the region inside the terminal housing is protected from contact, etc., in the contact position.

The electrical installation can for example be an appliance or even a switchgear cabinet or the like. Preferably, a conductor is connected to a current bar of the conductor receptacle. The current bar can be a separate part that is inserted or fitted into the lead-through terminal for example by the appliance manufacturer. The current bar can also be a component part of the lead-through terminal.

Preferably, the gap is arranged at a distance from the conductor receptacle and is in particular independent of the conductor receptacle. The gap is produced in particular when the actuation device pivots if, for example, a part or a component of the actuation device moves through the wall feedthrough during the pivot movement of said actuation device, in order to thus be able to make better use of the space available inside the electrical installation. An angle-dependent gap can thus result between the actuation device and the terminal housing, it being ensured in any case that a gap of this kind is closed at least in the contact position.

With the exception of the conductor receptacle, the wall feedthrough is in particular substantially completely or generally closed at least in the contact position.

In preferred developments, at least one closure ridge is provided on the actuation device, which ridge leads to the gap at the wall feedthrough being completely closed in the contact position. A closure ridge of this kind, which for example extends outwards from the actuation device, can reliably close any remaining gaps, at least in the contact position.

In preferred developments, the actuation device comprises at least one cover. The cover can be formed as a protective cover and/or consist at least in part or completely of an insulating material, for example.

Preferably, the closure ridge is provided on the cover. The closure ridge is thus captively held on the cover and is in any case used to automatically seal the wall feedthrough in the contact position.

In preferred embodiments, in the open position the gap is closed by a deflector. A deflector of this type can likewise be a part of an actuation device and in particular of the cover. Preferably, the cover consists at least in part and in particular completely or almost completely of at least one plastics material. This also creates effective protection against the inner parts of the actuation device being contacted, and the air gaps and creepage distances are increased.

Particularly preferably, an insert device is provided on the actuation device, it being possible to connect and/or lock the insert device to the cover. In simple cases, the cover is attached to the insert device, or is fixed in place and preferably locked thereon, by means of at least one latching lug in particular. Particularly preferably, at least one latching lug protrudes outwards on each opposite side of the insert device. Each latching lug preferably enters an opening in the cover and locks therein.

It is also preferable and possible for at least one other latching element or a plurality of other latching elements to be used to captively attach the cover to the actuation device. It is also possible for the insert device to also be captively held on the actuation device by the cover being fixed in place. As a result of such an embodiment, assembly time is also saved, since the individual components do not have to be attached separately and independently of one another, but rather can optionally be locked together so that both the cover and the insert device are fixed in place on the actuation device. As required, the locking or connection of the cover and the insert device can be released again whenever necessary.

In all embodiments, it is particularly preferable for the actuation device to comprise a clamping lever and a clamping spring. In the process, the clamping lever is used to apply the clamping force that is provided at least in part by the clamping spring.

Preferably, the lead-through terminal comprises a mount on which a current bar is held. At least one clamping spring is provided for applying a clamping force to clamp the conductor on the current bar. Furthermore, the clamping spring comprises a first leg and at least one second leg and is hingedly coupled to the clamping lever by the first leg and hingedly coupled to an auxiliary lever by the second leg. As a result, the clamping lever and the auxiliary lever are pivotally arranged on the mount.

An embodiment of this type allows for high clamping forces, which can also be reliably applied and guaranteed over long periods of time.

Advantageously, a first pivot pin and a second pivot pin, which is provided at a distance from the first pivot pin, are arranged on the clamping lever. The clamping spring preferably has a first pin receptacle and at least one second pin receptacle spaced apart therefrom. An auxiliary lever is also provided, which has a first rotary unit and at least one second rotary unit spaced apart therefrom. This means that the clamping lever, the clamping spring and preferably the auxiliary lever each comprise two separate joints remote from one another.

Preferably, the mount provides a friction connection via the clamping lever, the clamping spring and the auxiliary lever. Therefore, both an even higher clamping force and an even greater opening angle can be achieved using relatively few, simple components.

The mount can also be referred to as a clamping body and is used to receive the current bar and to pivotally attach the clamping lever.

The electrical lead-through terminal provides a tip lever terminal having dynamic lever transmission.

In all embodiments, it is preferable for an opening angle between the current bar and the clamping lever or a clamping edge of the clamping lever at the conductor receptacle to be greater than 45° and in particular greater than 60° and preferably greater than 75° in the open state. Opening angles of 90° and more are possible. This allows for pivoting into the conductor receptacle from above, and so even particularly rigid conductors having a large cross section of e.g. 5 $mm^2$, 10 $mm^2$, 20 $mm^2$ or more can be connected in a simple manner. It is simple to pivot the stripped conductor in from above. During assembly, large and solid conductors do not have to be bent and inserted into the screw terminal axially from the front before the conductor can be clamped, but rather can be pivoted in from above.

Preferably, the clamping lever is pivotally attached to the mount by means of the first pivot pin. In particular, the first pin receptacle of the clamping spring is provided in the first leg of the clamping spring and the second pin receptacle of the clamping spring is provided in the second leg of the clamping spring. Preferably, the first pin receptacle of the clamping spring arranged in the first leg is coupled to the second pivot pin of the clamping lever.

Advantageously, the first rotary unit of the auxiliary lever has a pin that is pivotally connected to the second pin receptacle in the second leg of the clamping spring. In particular, the second rotary unit of the auxiliary lever is pivotally arranged on the mount.

Preferably, the second rotary unit of the auxiliary lever has a rounded outer contour, which is pivotally held at an adapted rounded recess in the mount. Particularly preferably, the outer contour and the recess are each circular or circular-segment-shaped. In particular, the second rotary unit of the auxiliary lever is pivotally or rotatably held, and preferably supported, on the rounded outer contour of the mount.

It is possible and preferable for the second rotary unit of the auxiliary lever to comprise an opening into which a guide pin is inserted. In this case, the second rotary unit can be rotatably mounted at the opening by means of the guide pin. It is also possible, however, for the guide pin in the opening to not cause forces to be transmitted, but to be used substantially only for guiding. The guide pin can, for example, be a part of the housing and consist for example of a plastics journal that is pivoted or clipped into the opening. However, it is also possible for the guide pin to be a pin on the mount or to be inserted separately into the mount in order to pivotally hold and/or support the auxiliary lever on the second rotary unit.

In all embodiments, it is preferred for the clamping spring to be a part of an actuation device. In a simple embodiment, the actuation device consists merely of the clamping spring. The clamping spring preferably has a dual function: the clamping spring is used to apply the clamping force and at the same time is used as an actuation lever.

At least one tool opening is preferably provided in the actuation device in order to insert a tool and to actuate the electrical lead-through terminal, so as to clamp an electrical conductor for example or to release the clamping again.

The actuation device preferably comprises a tool receptacle. The tool receptacle can be provided on an insert device or an insert. It is possible and preferable for the clamping spring to have, for example, a substantially C-shaped cross section, and for the inner region of the cross section to be occupied at least partly and in particular practically completely by the insert device. The tool receptacle, which acts as a counter-bearing during actuation for transferring actuation forces, can be provided in the insert device.

The insert device can, for example, consist of plastics material. It is also possible, however, for the tool receptacle and/or a counter-bearing to be provided by tabs or the like bent on the clamping spring.

Preferably, an inner diameter of the tool opening is greater than an inner diameter of the tool receptacle. This produces many possibilities, since different angles for the tool receptacle in the insert device can be provided for example for different geometries and intended uses of the electrical lead-through terminal. Depending on the accessibility and geometric conditions, the orientation of the tool receptacle in the insert device can be at different angles to the surface of the tool opening in the clamping spring. It is thus possible to have a different configuration of the lead-through terminal as a whole by means of different insert devices. As a result, an increased range of uses can be achieved for different lead-through terminals simply by changing one single, simple component, without having to significantly increase the necessary stocks of parts.

The tool receptacle preferably extends transversely to the current bar. The angle between the tool receptacle and the current bar can vary in the open state and depends on the intended use.

The actuation device preferably acts on the clamping lever by means of the auxiliary lever.

In particularly preferred embodiments, the clamping spring acts as a tension spring at least in the clamped state. In particular, the clamping spring is substantially relieved of tension at least in the open state. Particularly preferably, the clamping spring is completely relieved of tension in the open state. The phrase "substantially relieved of tension" is understood within the meaning of the invention to be in particular an effective force that is less than 10% of the maximum clamping force.

In all embodiments, it is preferred for the clamping lever to be behind a dead centre when in the clamped state. As a result, force first needs to be exerted to move the clamping lever from the clamped state back into the open position. This leads to self-securing or self-locking of the clamped state and increases safety. This is preferably brought about in that the clamping spring acting as a tension spring can contract again slightly before reaching the clamped state, thus slightly reducing the tension.

In all embodiments, it is preferred for the end of the first leg and/or the end of the second leg of the clamping spring to each be bent to form the first and/or the second pin receptacle, respectively. This allows for simple production of the clamping spring and for reliable functioning.

In particularly preferred embodiments of the invention, at least the mount and the clamping lever and the auxiliary lever are designed as punched bent parts. This allows for particularly simple and inexpensive production and assembly.

Preferably, at least one groove is provided in the current bar for securing a conductor held and clamped on the current bar. Particularly preferably, the groove in the current bar is provided transversely to the insertion opening and is at least approximately arranged at the point where the clamping lever clamps the conductor against the current bar.

Preferably, at least one penetration guard is provided, which prevents a received conductor from penetrating the lead-through terminal. For example, a penetration guard of this kind can consist of a part that is held in a groove in the current bar and is inserted from the outside through corresponding holes in the mount and is thus securely held on the mount.

The electrical lead-through terminal allows a high clamping force to be applied with a large opening angle of 60° or 75° or more possible at the same time. Even with conductors having large cross sections of 20 $mm^2$, 25 $mm^2$, 30 $mm^2$ or 35 $mm^2$, zero clamping is made possible after the first time such a conductor is clamped and removed, in which a thin conductor having a cross section of 1 mm, 0.5 mm or less can then still be reliably clamped by the clamping lever.

When the electrical lead-through terminal is transferred from the open state to the clamped state, the clamping lever is first largely closed without force or almost without force, before a high clamping force is applied when the tool is pivoted further.

Hereinafter, the design and the functioning of a lead-through terminal 100 and an electrical installation 500 equipped with at least one such lead-through terminal will be explained with reference to the accompanying drawings.

In this case, FIG. 1 shows two perspective views, side by side, of a lead-through terminal 100, specifically in the clamping state or the contact position 145 on the left and in the open state or open position 144 next to it on the right.

Figure 2:
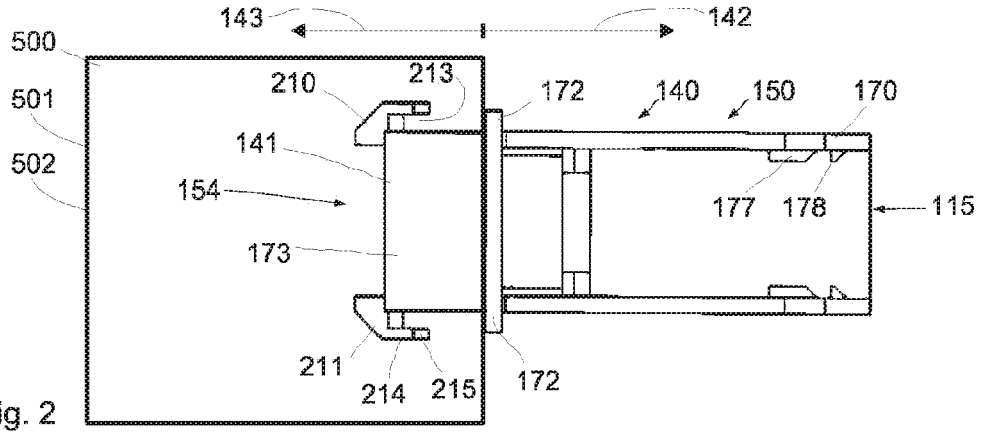
FIG. 2 is a schematic plan view of a wall of an electrical installation having a terminal housing held thereon.

The lead-through terminal 100 comprises a terminal housing 150 and is intended for abutting a wall 502 of an electrical installation 500 by means of the bearing portion 172 (cf. FIG. 2). In the contact position 145, the conductor receptacle 115 is largely closed, while a particularly large opening angle between the current bar and the clamping lever of possibly 75° or more is produced in the open position 144. As a result, it is made simpler to pivot a conductor (cf. FIG. 11) into the conductor receptacle 115, which can greatly simplify the connecting process, in particular with conductors having a cross section of several square millimeters.

The terminal housing 150 consists in particular of an electrically non-conductive material and preferably of a plastics material. The bearing portion 172 can be provided as a peripheral ridge by which the lead-through terminal 100 is supported peripherally on the wall 502. It is also possible for the bearing portion 172 to consist of a plurality of segments or individual supporting elements.

The tool opening 109, which is provided in the actuation device 103, is visible on the lead-through terminal 100 both in the contact position 145 and the open position 144. The actuation device 103 comprises a covering housing in the form of a cover 153. The cover 153 in this case consists of an insulating material and protects the interior of the actuation device 103 and also the interior of the lead-through terminal 100 from mechanical contact. The air and creepage distances are also considerably increased by the cover 153.

The terminal housing 150 can comprise an outer housing 170 and an inner housing 160, on which the mount 108 is held. The mount 108 preferably consists of metal and in particular of a punched bent part. The outer housing and inner housing preferably consist of a plastics material. During assembly, the mount 108 is held on the inner housing 160 and the necessary metal parts and clamping parts are mounted. Together with the mount 108, the inner housing forms a pre-assembled structural unit, which then merely has to be placed in the outer housing 170, or inserted or locked into an outer housing that is already present on an electrical installation 500 and, for example, formed thereon integrally with the wall.

The lead-through terminal 100 comprises the pivotable actuation device 103. By pivoting the actuation device 103, the lead-through terminal can be opened or closed again. When pivoting the actuation device 103, a gap 148 can be produced between the peripheral wall of the bearing portion 172 and the cover 153 of the actuation device 103, specifically at the point where the closure ridge 149 is located when in the contact position 145. If the actuation device 103 is pivoted backwards from the closed position shown on the left in FIG. 1, the closure ridge 149 is pivoted through the wall feedthrough 154 and thus through the wall 502 into the electrical installation 500. At the same time, a gap 148 is also produced between the wall 172 and the cover 153 at the point where the closure ridge 149 was arranged previously. Upon further pivoting into the open position 144, the gap 148 is finally closed by the deflector 155, and so there is no gap 148 in the open position. The gap 148 is at a distance from the conductor receptacle 115 and is independent of the conductor receptacle 115.

FIG. 2 is a highly schematic plan view of an electrical installation 500 comprising a wall 502, on which a lead-through terminal 100 is held, only the outer housing 170 thereof being shown in FIG. 2 for the sake of clarity. Inside the outer housing 170, lugs 177 and 178 are provided, on which the inner housing 160 is locked during assembly.

The shape of the latching units 210, which are formed as latching arms 211, can be seen in FIG. 2. The legs of the latching arms 211, which legs extend away from the terminal housing 150, are covered in this case by the support wall that also acts as the counter-bearing element 173. In this case, the width of the support wall 173 corresponds exactly to the external spacing of the two latching arms 211 visible in FIG. 2. As will be explained with reference to FIG. 4, this ensures that the latching arms can briefly resiliently pivot inwards when they are installed on the wall 502, yet are later retained on the outside by the latching units 220 that interact with the latching arms, and so the cross section of the wall feedthrough 154 remains free.

Figure 3:
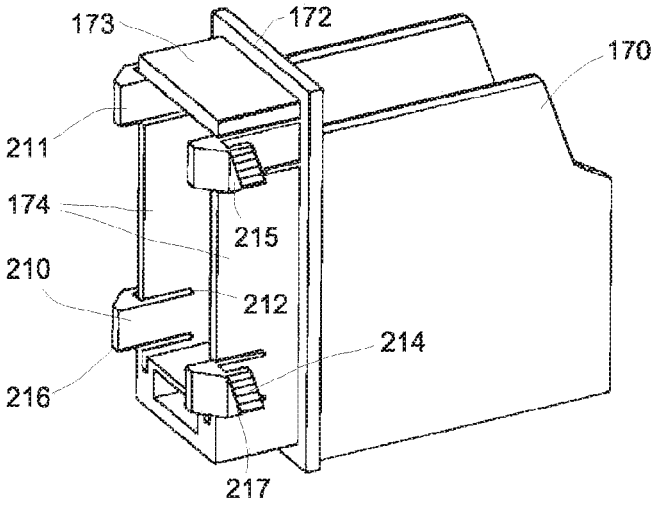
FIG. 3 is a perspective view of a terminal housing.

FIG. 3 is a perspective view of the terminal housing 150 or the outer housing 170 thereof, comprising the first housing portion 140 on a first side 142 of the bearing portion 172 and thus outside the electrical installation 500. The second housing portion 141 is arranged inside the housing 501 on the second side 143. The second housing portion 141 is used here as an attachment portion, on which the counter-bearing elements 173, together with the latching arms 211 and the walls 174, provide a peripheral wall. As a result, the interior of the second housing portion 141 is mechanically protected from influences and contact if, for example, part of the actuation device 103 enters the second housing portion 141.

The latching arms 211 are approximately U-shaped at the free ends 216. Between the returning leg 215 and the latching arm 211, a groove 213 is provided, which a part of the latching unit 220 enters.

An engagement unit 217 is provided on the outer oblique surface 214 and is formed here as a latching toothing or a plurality of latching teeth. The latching toothing 217 on the opposite latching arms 211 is arranged in each case on the outer surfaces that face away from one another and which are each transverse to the transverse direction 204 (cf. FIG. 4). The outer surfaces can be arranged perpendicularly to the transverse direction 204, but are in particular arranged at a small angle thereto of between 0° and 30°.

Owing to the grooves 212 between the side wall and the latching arms 211, the latching arms 211 can resiliently deflect during assembly.

FIG. 4 shows a lead-through terminal 100 installed on a wall 502 of an electrical installation 500, in which a part of the second housing portion 141 of the terminal housing 150 can be seen schematically behind the wall 501. In principle, however, the terminal housing 150 is also suitable for use in other electrical connection terminals.

To attach the lead-through terminal 100, a locking system 201 is provided, which in this case comprises four latching units 210 and four latching units 220. The latching units 210 are in the form of latching arms 211 which are resiliently held on the terminal housing 150 and extend as far as to their free end 216, where the latching arms 211 are U-shaped, and so the latch groove 213 is suitable for receiving the latching units 220. The latching units 220 designed as latch connectors 221 can be individual separate parts, as shown in FIG. 4, or they can be interconnected, for example by means of a flexible connector 225 or a clip, as shown in the enlarged view in FIG. 5.

Each latching connector 221 comprises a latching body 222, which has an approximately cuneiform structure 223 so as to thus be able to bring about clamping on walls 502 of different thicknesses.

For installation, the second housing portion 141 of the terminal housing 150 is inserted through the opening in the wall 502, the resilient latching arms 211 briefly resiliently bending inwards when the latching arm 211 in question passes through the wall 502. After this, the latching arms 211 snap outwards again. The terminal housing 150 then cannot be easily removed again. To attach the terminal housing 150, the latching units 220 are then placed on. In the process, the latching connectors 221 are placed, with their groove 226, on the legs 215 of the latching arms 211, and so the latching elements 217 are brought into a latching connection, on their oblique surface 224, with the latching toothing 227 on the latching connectors 221. When the latching connectors 221 move in the latching direction 202, the ends of the latching arms 211 are clamped by the cuneiform latching bodies 222 of the latching connectors 221 and are pushed away from the wall 502. In this way, secure retention can be ensured even with different wall thicknesses or cuneiform or step-like walls 502. In the process, the latching toothing 227 extends transversely to the connection direction. The latching toothings 217 and 227 are each provided on oblique surfaces 214 and 224, respectively, which abut one another when in the installed state.

In this case, clamping takes place at each of the four individual latching arms 211, and so even different wall thicknesses do not affect the individual latching arms 211.

In the installed state, as shown in FIG. 4, the support wall 173 forms a counter-bearing element, against which the adjacent latching arms 211 are supported. This ensures that the wall feedthrough 154 or the space between the support walls 173 remains free. If, after being inserted into the wall 502, a resilient latching arm 211 does not resiliently bend back outwards by itself, the latching arm 211 is pulled outwards by the latching connectors 221, since the latching connectors 221 are supported on the support wall 173, acting as a counter-bearing, by their latching bodies 222.

In this way, reliable functioning of the lead-through terminal 100 can be ensured, since the clamping spring 101 and other components of the actuation device are partly pivoted through the wall feedthrough 154 when the actuation device 103 moves from the contact position 145 into the open position 144. Therefore, it has to be ensured that the installation space inside the electrical installation 500 that the second housing portion 141 occupies does not create any obstructions during the pivot movement.

FIG. 6 is a schematic perspective view of an open lead-through terminal 100 without an outer housing 170 but having an installed plastics inner housing 160 on which the metal mount 108 is held. The mount 108 of the lead-through terminal 100 has an approximately U-shaped cross section and consists in this case of a punched bent part. The current bar 110 is held on the mount 108.

The lead-through terminal 100 is shown in the open position 144, in which a conductor to be connected can be pivoted into the conductor receptacle 115 from above. A conductor can optionally also be inserted from the front.

Chamfers 161 and 162 acting as insertion aids are provided at the conductor receptacle 115 in the plastics wall of the inner housing 160. The latch openings 165 and 166 in the outer side walls are intended for holding the lugs 177 and 178 on the inner walls of the outer housing 170, as a result of which the terminal housing is fixed together in itself.

The actuation device 103 is covered by a cover 153. The closure ridge 149, which closes a gap 148 between the bearing wall or the bearing portion 172 and the wall feedthrough 154 in the contact position 145, is provided on the cover 153. In the open position 144, the deflector 155 closes the gap 148. In the contact position 145, the wall 185 covers the conductor receptacle 115 at the top. Furthermore, the wall 185 can define an insertion funnel for a tool. An insertion funnel of this type can be provided if side walls connect the deflector 155 and the wall 185, so the tool receptacle 109 is surrounded by walls in a funnel-shaped manner.

On the side, an opening 158 in the cover 153 can be seen, by which opening an insert device 118 having protrusions 157 is locked from the inside.

In the conductor receptacle 115, a penetration guard 117 is provided, which prevents a conductor to be connected from being inserted too far. The penetration guard 117 is arranged at a groove 116 (cf. FIG. 9) and prevents an inserted conductor from passing through, and also secures the current bar 110 inside the mount 108.

In addition, the clamping lever 102 having the clamping edge 122 can be seen, as can the auxiliary lever 104 having the cross connector 105. The clamping lever 104 is held on the mount 108 so as to be rotatable about the axis of the journal 151. In this case, only the insertion guard 156 of the insert device 118 can be seen, which guard reliably prevents a conductor from being inserted into the region of the clamping spring 101 above the conductor receptacle 115 in the open position 144.

Figure 7:
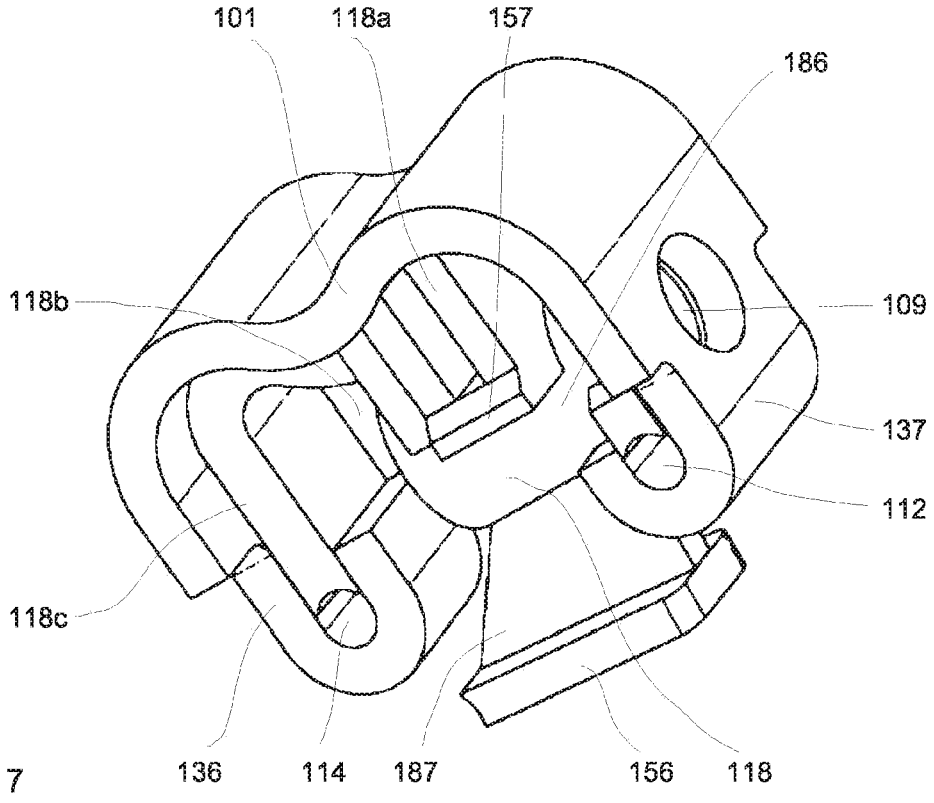
FIG. 7 shows the insert device and the clamping spring of the lead-through terminal according to FIG. 1 and FIG. 6.

FIG. 7 shows the insert device 118 on the clamping spring 101. The insert device 118 is part of a multifunctional inner part 186. The inner part 186 comprises the insert device 118 having the receiving opening 132 (cf. FIG. 9) and the insertion guard 156, as well as the latching lugs in the form of protrusions 157 for fixing the cover 153 in place. The two latching lugs 157 protrude outwards to the side and lock with the two side openings 158 in the cover 153.

The clamping spring 101 provides the necessary clamping force on the lead-through terminal 100. The clamping spring 101, having its generally C-shaped design when viewed from the side, comprises, inside the "C", an insert device 118, here in the form of a plastics insert, and is used as a counter-bearing for a tool 120 (cf. FIG. 9) when the lead-through terminal 100 is being actuated. The clamping spring 101 is loaded with tensile force so that the two legs 136 and 137 of the clamping spring 101 separate when load is applied. The "C" is open in the direction of the conductor receptacle 115.

Figure 8:
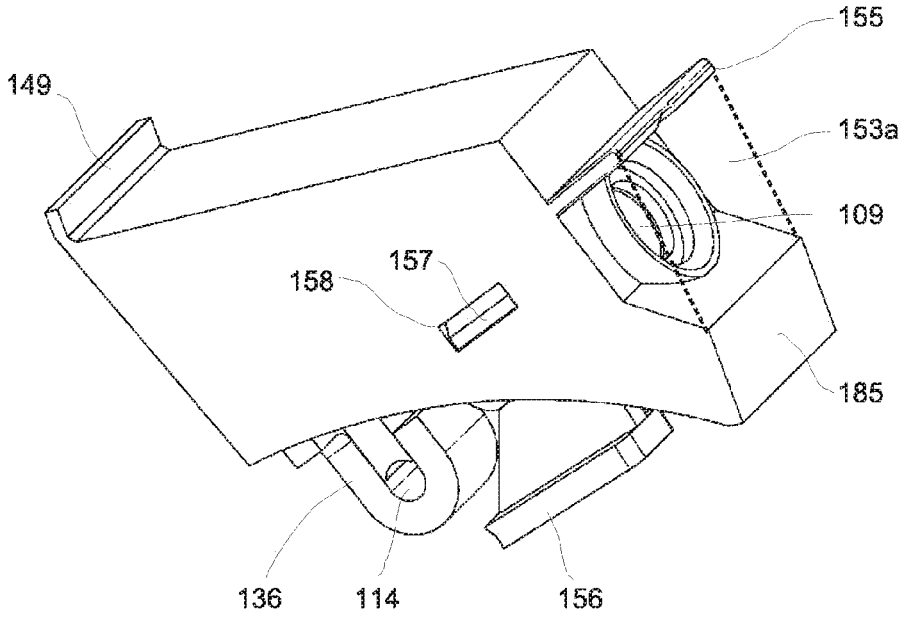
FIG. 8 is a perspective view of the actuation device of the lead-through terminal according to FIGS. 1 and 6.

In this case, the clamping spring 101 is also used as the actuation device 103 or the actuation lever and comprises the plastics insert and the cover 153 shown in FIG. 8, in addition to the clamping spring 101. In the second leg 137 of the clamping spring 101, a tool opening 109 is provided, through which a tool 120 such as a screwdriver can be inserted in order to move the lead-through terminal 100 out of the open state 144 into the clamped state 145 and back again by means of the movement of the screwdriver. The receiving opening 132 or the wall that surrounds the receiving opening 132 in the insert device 118 is used as the counter-bearing during actuation. The insert device 118 comprises an insert body 118*a*, an in particular resilient holding leg 118*c*, and a gap 118*b* therebetween. This allows the insert device 118 to abut the two legs 136, 137 of the clamping spring 101 even in the event of spring movements. The retaining leg 118*c* can be rigidly connected to the first leg 136 of the clamping spring 101 or clamped thereon.

The second pivot pin 114 on the first leg 136 of the clamping spring 101 and the pin 112 on the second leg 137 can be seen. The protrusions 157 lock with the openings 158 in the cover 153. By means of a ridge 187, the planar insertion guard 156 is in particular integral with the insert body 118*a*.

FIG. 8 shows the clamping spring 101 having the insert device 118 and the mounted cover 153. The protrusion 157 on the insert device 118 can be seen at the opening 158. On the lower end, the closure ridge 149 can be seen at the back and the deflector 155 can be seen at the top. If side walls are provided, as indicated by the dashed lines, an insertion funnel is provided for the tool 120.

Figure 9:
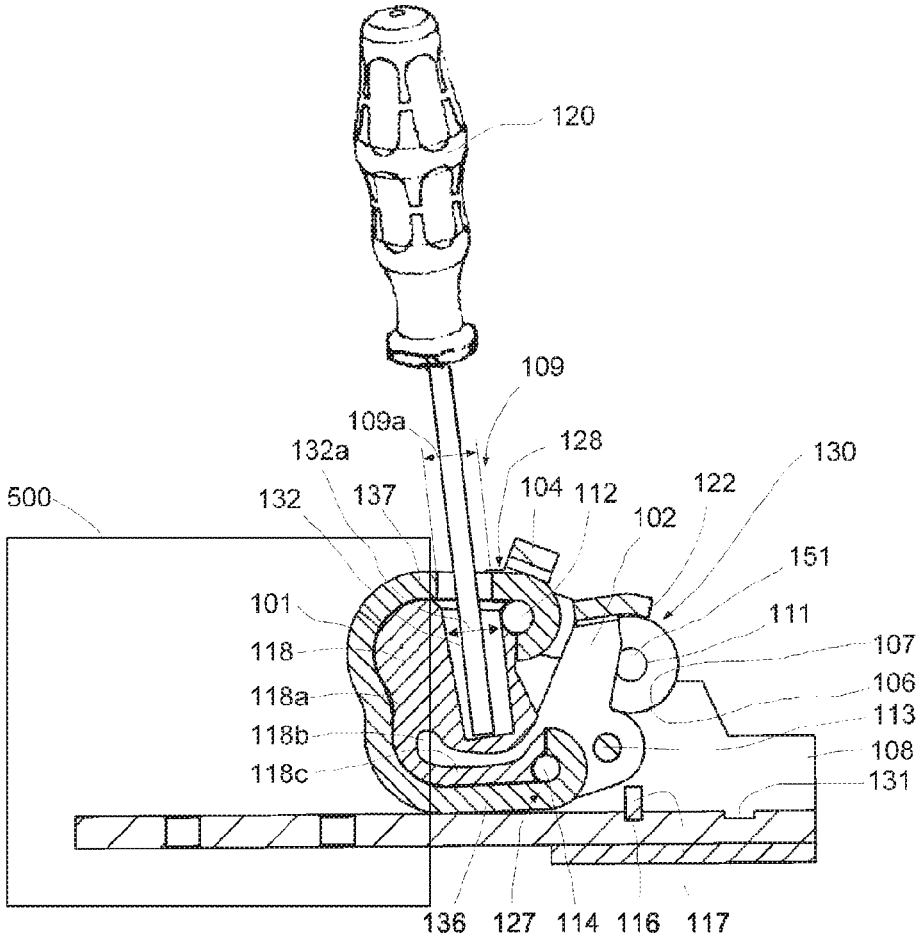
FIG. 9 is a schematic sectional side view of the lead-through terminal without an outer housing.

FIG. 9 is a schematic sectional side view of the lead-through terminal 100 having an insert device 118 formed as a plastics insert. Only the mount 108 is shown, whilst the terminal housing 150 is not depicted in FIG. 9. By pivoting the tool 120 clockwise, i.e. towards the clamping lever 102, the electrical lead-through terminal 100 is moved from the open state 144 shown in FIG. 9 into the clamped state 145.

The first pivot pin 113 and the second pivot pin 114 are held on the clamping lever 102. The clamping lever 102 can generally pivot about the first pivot pin 113 held on the mount 108, and so the clamping edge 122 of the clamping lever 102 is also pivoted when the clamping lever 102 is pivoted.

The first leg 136 of the clamping spring 101 is rotatably held on the second pivot pin 114 of the clamping lever 102. The second leg 137 of the clamping spring 101 can pivot with respect to the first rotary unit 129 (cf. FIGS. 11 and 12) of the auxiliary lever 104. The second rotary unit 130 of the auxiliary lever 104 is rotatably held on the round recess 106 in the mount 108 by means of the round outer shape 107.

Figure 11:
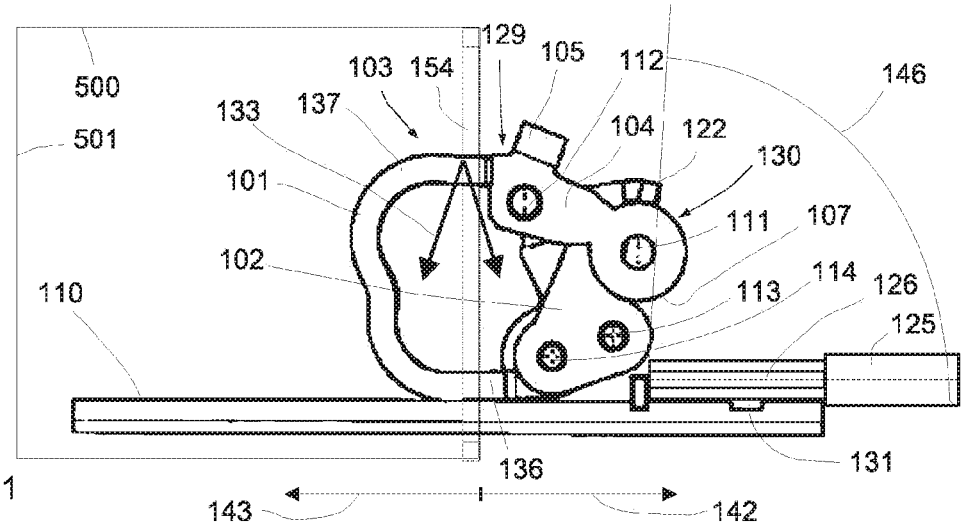
FIG. 11 is a highly schematic side view of the lead-through terminal in the open state.

The insert device 118 can be seen in section in FIG. 9. In order to better identify the other components, the insert guard 156 having the ridge 187 has been omitted in the illustration. A receiving opening 132 for receiving a tool 120 is provided in the insert device 118. In this case, an inner diameter 109*a* of the tool opening 109 in the clamping spring is provided with a larger diameter than the inner diameter 132*a* of the receiving opening 132 in the plastics insert 118. As a result, the clamping spring 101 can be provided for use with different insert devices 118 or with plastics inserts having different receiving openings 132. This allows for the provision of different lead-through terminals 100 in which only the insert device 118 differs and thus the operating angle changes. FIG. 11 is a schematic view of two different angles, which are shown for example by arrows 133.

The clamping lever 102 comprises two parallel side walls, between which the clamping edge 122 is provided. The clamping lever 102 is designed as a single-piece punched bent part in this case.

A groove 116 is provided in the current bar 110, in which groove a rod-shaped penetration guard 117 is formed, which is received in corresponding side openings in the walls 123 of the mount 108. As a result, the current bar 110 is secured in the axial direction, and in addition a penetration guard for a conductor 126 is made possible.

In addition, a groove 131 is provided in the current bar 110 and is arranged at the point where the clamping edge 122 pushes an inserted conductor 126 against the current bar 110. As a result, conductors 126 can be deformed into the groove 131 during the clamping operation, and so effective pull-out protection can be ensured.

In the sectional view according to FIG. 9, the first pin receptacle 127 on the first leg 136 of the clamping spring 101 can be seen in section. In the process, the first pin receptacle 127 encloses the second pivot pin 114 of the clamping lever 102.

At the other end of the clamping spring 101, i.e. on the second leg 137, the second pin receptacle 128, which encloses the pin 112 of the first rotary unit 129 of the auxiliary lever 104, can be seen in section.

The guide pin 151 in the hole 111 or the virtual axis of rotation of the second rotary unit 130 of the auxiliary lever 104 can be seen in the section.

Figure 10:
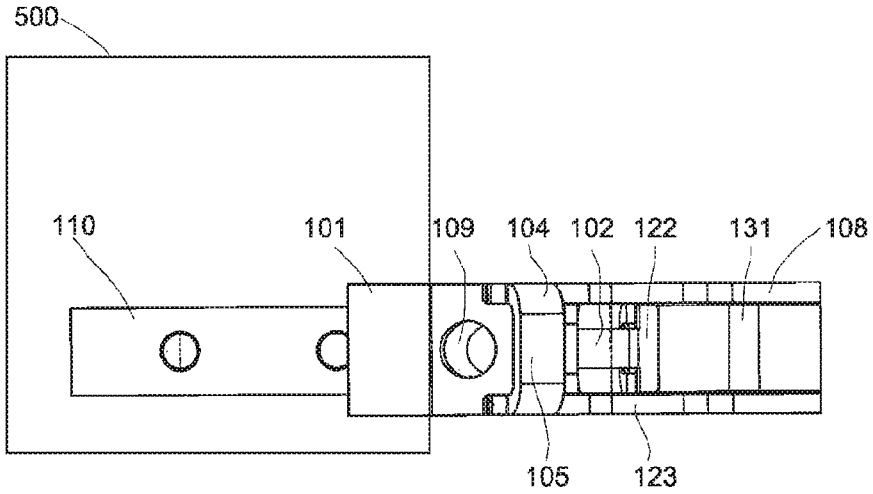
FIG. 10 is a plan view of the lead-through terminal according to FIG. 12.

FIG. 10 is a plan view of the electrical lead-through terminal 100. The tool opening 109 can be seen in the clamping spring 101. The auxiliary lever 104 encloses the second leg 137 of the clamping spring 101 by means of the cross connector 105. The clamping lever 102 comprises the clamping edge 122, which in this case is facing to the right and which engages in the groove 131 in the clamped state or pushes a conductor against the groove 131 in the current bar 110.

In the following, the functioning of the lead-through terminal 100 will be explained with reference to FIGS. 11 to 13. FIG. 11 is a schematic view of a cable 125 having an electrical conductor 126. In the illustrations according to FIGS. 11 to 13, various parts of the electrical lead-through terminal 100 have been omitted to better illustrate the functioning. The terminal housing 150 has thus also been omitted in FIGS. 11 to 13, as has the mount 108. It should be noted, however, that the clamping lever 102 is rigidly connected to the mount 108 by means of the first pivot pin 113. Furthermore, the second rotary unit 130 of the auxiliary lever 104 is in this case immovably supported on the correspondingly round recess 106 in the mount 108 by means of the round outer shape 107, i.e. on the round recess 106 in the mount 108.

To illustrate the movement sequences, a housing 501 of an electrical installation 500 is shown highly schematically and by dashed lines.

Here, the opening angle 146 between the current bar 110 and the clamping edge 122 of the clamping lever 102 is considerably more than 75° and almost 90°. Depending on the geometric design of the clamping lever 102, the opening angle 146 can also be selected to be even larger. Generally, however, this opening angle 146 is sufficient to be able to pivot even particularly rigid conductors 126 of large cross sections into the pivot region 115 from above.

Figure 12:
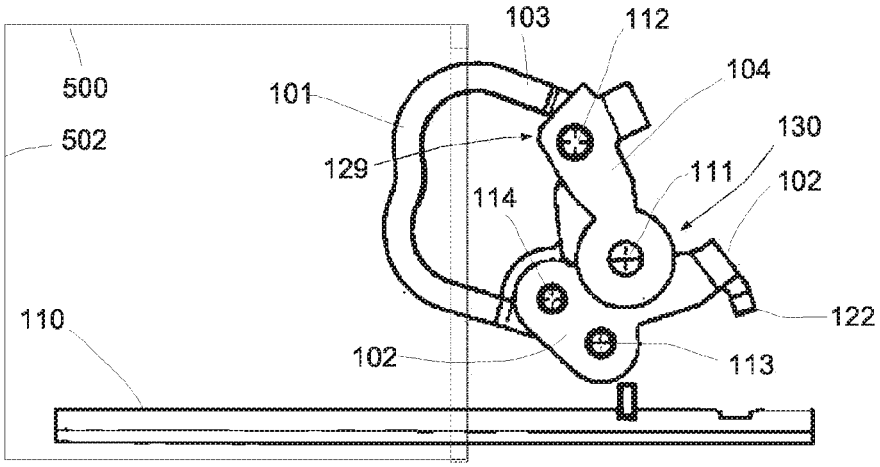
FIG. 12 is a highly schematic side view of the lead-through terminal in an intermediate position.

While FIG. 11 shows the open state 144, FIG. 12 shows an intermediate state, in which the clamping lever 102 has already been pivoted by a considerable amount. This occurs by a tool being inserted into the tool opening 109 in the clamping spring 101 and being pivoted clockwise in the view according to FIGS. 11 to 13. When moving from the state shown in FIG. 11 to that shown in FIG. 12, the pivoting takes place practically without force, since the distance between the two legs 136 and 137 of the clamping spring 101 does not change or practically does not change, and thus the spring tension practically does not change. This achieves comfortable operation.

With conductors having very large cross sections, in the state shown in FIG. 12 the clamping edge 122 can almost already be abutting the conductor 126. When moving from the state shown in FIG. 11 to that shown in FIG. 12, the clamping lever 102, the clamping spring 101 and the auxiliary lever 104 pivot in a manner coupled to one another in each case.

Figure 13:
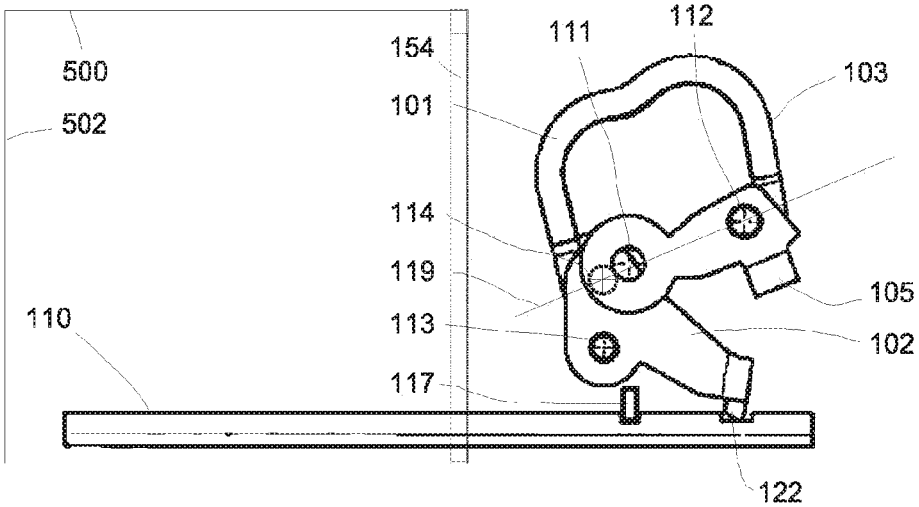
FIG. 13 is a highly schematic side view of the lead-through terminal in the clamped state.

FIG. 13 shows the clamped state 145. It can clearly be seen that zero clamping can also be achieved, in which even conductors having the smallest of cross sections can be clamped. In FIG. 13, the clamping edge 122 abuts the groove 131 in the current bar 110. When pivoting from the state shown in FIG. 12 into the clamped state 145 according to FIG. 13, the clamping spring 101 is tensioned, the distance increasing between the first leg 136 and the second leg 137. Therefore, owing to the sturdy clamping spring 101, a high clamping force is generated.

Comparing FIGS. 11 to 13 shows that the actuation device 102 is located on the first side 142 to a greater extent when in the contact position 145 according to FIG. 13 than when in the open position 144 according to FIG. 11, in which at least part of the actuation device 103 and even the most substantial part of the clamping spring 101 extend through the wall feedthrough 154 onto the second side 143. This means that the actuation device 103 and in particular the clamping spring 101 enter the housing 501 of the electrical installation at least in part in the open position 144. In the open position 144, a significant part is located on the second side 142 and thus inside the housing 501. In the process, a significant portion of the volume, the mass and the cross-sectional surface area is located on the second side 143. In the contact position 145, the actuation device 103 remains substantially or even completely on the first side or the outside 142.

Therefore, the installation space of the lead-through terminal can be significantly reduced. Some of the volume required is used on the inside of an electrical installation, where there is typically sufficient space, in particular when another connection is provided on the second side of the lead-through terminal. It is possible, for example, for the current bar to lead on directly.

FIG. 13 shows a self-locking state. When the clamping spring 101 and the auxiliary lever 104 pivot, a dead centre is passed, so in the clamped state 145 the clamping spring 101 is slightly relieved of tension compared with the maximum pretension. This produces a stable state. The self-locking state can be recognised in this case by the connecting line 119 between the pin 112 and the second pivot pin 114 extending almost under the centre of the hole 111 or under the virtual axis of rotation of the second rotary unit 130 of the auxiliary lever 104. As a result, when the electrical lead-through terminal is moved into the open state 144, the clamping spring 101 has to first be pretensioned further in order to overcome the dead centre.

The second pivot pin 114 is shown in dashed lines in FIG. 13 since it is located behind the second rotary unit 130 of the auxiliary lever 104, and thus is not actually visible in this view.

Overall, a very advantageous electrical lead-through terminal 100 is provided. The lead-through terminal is able to be produced in batch production and can be produced from simple components.

The electrical lead-through terminal 100 designed as a tip lever terminal comprises a dynamic lever transmission, in which the clamping edge 122 covers a large path at the start of the closing operation and in which a relatively short path is covered by the tool upon further closing by means of a slight force, which is converted into a high clamping force.

The clamping spring 101, the clamping lever 102, the auxiliary lever 104 and the mount 108 can be produced from punched bent parts. This enables simple and inexpensive production, even for mass production. The maximum opening angle 146 can be very large, so that even the most solid of conductors can be pivoted into the pivot region 115, which is open to the top.

Settling in the spring or other components is reliably prevented, and in principle clamping forces of any size can be applied by an appropriate selection of the wall thicknesses of the clamping spring 101 and the other dimensions.

To mount the auxiliary lever 104 together with the second rotary unit 130 on the mount 108, the second rotary unit 130 can have a round outer contour 107, which engages in a correspondingly round recess 106 in the mount 108. This is possible because no tensile forces occur here, and so a simple plastics journal 151 of the housing 150 is sufficient at the hole 111.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

Lead-through terminal 100
Clamping spring 101
Clamping lever 102
Actuation device 103
Auxiliary lever 104
Cross connector 105
Recess 106
Outer shape 107
Mount 108
Tool opening 109
Current bar 110
Hole 111
Pin 112
First pivot pin 113
Second pivot pin 114
Conductor receptacle, pivot region 115
Groove 116
Penetration guard 117
Insert device 118
Insert body 118*a*
Gap 118*b*
Retaining leg 118*c*
Connecting line 119
Tool 120
Clamping edge 122
Side, wall 123
Cable 125
Conductor 126
First pin receptacle 127
Second pin receptacle 128
First rotary unit 129
Second rotary unit 130
Groove 131
Receiving opening 132
Diameter 132*a*
Arrow 133
First leg 136
Second leg 137
First housing portion 140
Second housing portion 141
First side, outside 142
Second side, inside 143
Open state, open position 144
Clamped state, contact position 145
Opening angle 146
Gap 148
Closure ridge 149
Housing, terminal housing 150
Journal 151
Cover 153
Tool access 153*a*
Wall feedthrough 154
Deflector 155
Insertion guard 156
Latching lug, protrusion 157
Opening 158
Inner housing 160
Chamfer 161, 162
Latch opening 165, 166
Outer housing 170
Bearing portion, bearing wall 172
Counter-bearing element, support wall, wall 173
Wall 174
Lug 177, 178
Wall 185
Multi-functional inner part 186
Ridge 187
Locking system 201
Latching direction, first direction 202

Transverse direction 204
Latching unit 210
Latching arm 211
Groove 212, 213
Oblique surface 214
Leg 215
Free end 216
Engagement unit 217
Latching unit 220
Latching connector 221
Latching body 222
Cuneiform shape 223
Oblique surface 224
Clip/connector 225
Groove 226
Latching toothing 227
Electrical installation 500
Housing 501
Wall 502

The invention claimed is:

1. A lead-through terminal, comprising:

a terminal housing configured to be held on a wall of an electrical installation at a wall feedthrough of the wall; and a pivotable actuation device being provided on the terminal housing, the actuation device being pivotable at least between a contact position and an open position and being configured to clamp a conductor at a conductor receptacle in the contact position and to release or hold the conductor at the conductor receptacle in the open position, wherein a gap that exists between the actuation device and the wall feedthrough when the actuation device pivots between the open position and the contact position is closed at least in the contact position by the actuation device.

2. The lead-through terminal of claim 1, wherein a closure ridge is provided on the actuation device, which closure ridge is configured to completely close the gap in the contact position.

3. The lead-through terminal of claim 1, wherein the actuation device comprises a cover.

4. The lead-through of claim 3, wherein the cover comprises, at least in part, an insulating material.

5. The lead-through terminal of claim 3, wherein a closure ridge is provided on the cover.

6. The lead-through terminal of claim 1, wherein the gap is closed in the open position by a deflector.

7. The lead-through terminal of claim 1, wherein a tool opening is provided in the actuation device.

8. The lead-through terminal of claim 3, wherein the cover is fixed in position on an insert device on the actuation device and is locked on at least one latching lug of the insert device.

9. The lead-through terminal of claim 1, wherein at least part of the actuation device is configured to enter the wall feedthrough during the pivot movement.

10. The lead-through terminal of claim 1, wherein the actuation device comprises a clamping lever and at least one clamping spring.

11. The lead-through terminal of claim 10, further comprising a mount on which a current bar is held, wherein the actuation device comprises the at least one clamping spring, which is configured to apply a clamping force to clamp the conductor on the current bar, wherein the clamping spring comprises a first leg and at least one second leg and is hingedly coupled to the clamping lever by the first leg and hingedly coupled to an auxiliary lever by the second leg, and wherein the clamping lever and the auxiliary lever are pivotally arranged on the mount.

12. The lead-through terminal of claim 11, wherein a first pivot pin and at least one second pivot pin spaced apart therefrom are arranged on the clamping lever, wherein the clamping spring has a first pin receptacle and at least one second pin receptacle spaced apart therefrom, and wherein the auxiliary lever is provided, the auxiliary lever comprising a first rotary unit and at least one second rotary unit spaced apart therefrom.

13. The lead-through terminal of claim 11, wherein an opening angle between the current bar and the clamping lever at the conductor receptacle in an open state is greater than 45°.

14. The lead-through terminal of claim 7, wherein an inner diameter of the tool opening is greater than an inner diameter of a receiving opening in an insert device on the actuation device.

15. The lead-through terminal of claim 13, wherein the opening angle is greater than 60°.

16. The lead-through terminal of claim 15, wherein the opening angle is greater than 75°.

* * * * *